US009080561B2

(12) United States Patent
Klahm et al.

(10) Patent No.: US 9,080,561 B2
(45) Date of Patent: Jul. 14, 2015

(54) HYDRAULIC AGGREGATE

(75) Inventors: Harald Klahm, St. Ingbert (DE); Frank Liedtke, Kamen (DE)

(73) Assignee: HYDAC FLUIDTECHNIK GMBH, Sulzbach/Saar (DE)

( * ) Notice: Subject to any disclaimer, the term of this patent is extended or adjusted under 35 U.S.C. 154(b) by 1127 days.

(21) Appl. No.: 12/737,242

(22) PCT Filed: Apr. 27, 2009

(86) PCT No.: PCT/EP2009/003039
§ 371 (c)(1),
(2), (4) Date: Jan. 27, 2011

(87) PCT Pub. No.: WO2009/156017
PCT Pub. Date: Dec. 30, 2009

(65) Prior Publication Data

US 2011/0173966 A1 Jul. 21, 2011

(30) Foreign Application Priority Data

Jun. 27, 2008 (DE) ..... 10 2008 030 715

(51) Int. Cl.
*F15B 1/26* (2006.01)
*F04B 23/02* (2006.01)
*B66F 9/22* (2006.01)

(52) U.S. Cl.
CPC ..... *F04B 23/028* (2013.01); *B66F 9/22* (2013.01); *F15B 1/26* (2013.01)

(58) Field of Classification Search
CPC ..... F15B 1/26; F04B 23/028
USPC ..... 92/78, 142, 128; 60/325, 454, 477, 478; 137/43, 44, 590, 565.17, 800, 899.4; 220/661, 780; 174/559, 560, 561; 310/89; 361/752; 417/360; 285/407
See application file for complete search history.

(56) References Cited

U.S. PATENT DOCUMENTS 1,371,007 A * 3/1921 Urban ..... 232/43.1
2,831,490 A * 4/1958 Simcock ..... 137/38

(Continued)

FOREIGN PATENT DOCUMENTS

DE 85 09 603 U1 5/1985
DE 197 39 233 A1 3/1999
DE 10 2004 032256 B3 12/2005

OTHER PUBLICATIONS

English translation of DE 8509603U1 received on Oct. 4, 2013.*

(Continued)

*Primary Examiner* — F. Daniel Lopez
(74) *Attorney, Agent, or Firm* — Roylance, Abrams, Berdo & Goodman LLP

(57) ABSTRACT

A hydraulic aggregate, particularly for supplying conveyor and lifting devices with pressurized fluid, has a tank (1) on the end side relative to a main axis of the device and functional components mounted on it. The functional components are a hydraulic pump (5) and a coupling body (3) having a valve device and a line arrangement for drawing in and returning hydraulic fluid to and from the tank (1). Configured as a reversing aggregate, the inlet end (19) of the suction line (15) of the line arrangement is disposed at a location within the tank (1) where the bottom of the fluid present in the tank (1) is located when the aggregate is operated with the main axis vertical and when the aggregate is operated with the main axis tilted relative to the vertical, preferably perpendicular to the vertical.

20 Claims, 4 Drawing Sheets

(56) References Cited

U.S. PATENT DOCUMENTS

| | | | | | |
|---|---|---|---|---|---|
| 2,861,578 | A | * | 11/1958 | Thompson | 132/73.6 |
| 3,450,908 | A | * | 6/1969 | Mabuchi | 310/43 |
| 3,928,969 | A | * | 12/1975 | Picker | 60/428 |
| 3,977,189 | A | * | 8/1976 | Kubik | 60/453 |
| 4,241,578 | A | * | 12/1980 | Keene | 60/478 |
| 4,827,719 | A | * | 5/1989 | Paoluccio | 60/478 |
| 5,236,000 | A | * | 8/1993 | Kizer | 137/38 |
| 7,007,716 | B2 | * | 3/2006 | Smahl et al. | 285/407 |

OTHER PUBLICATIONS

English translation of DE 19739233A1 received on Oct. 7, 2013.*

* cited by examiner

HYDRAULIC AGGREGATE

FIELD OF THE INVENTION

The invention relates to a hydraulic aggregate, particularly for supplying conveyor and hoisting gear with pressurized fluid, having a tank on the end side relative to a major axis of the device and functional components mounted thereon. The functional components comprise at least one hydraulic pump and one connecting body with a valve device and a line arrangement for intake and return of hydraulic fluid to and from the tank.

BACKGROUND OF THE INVENTION

Hydraulic aggregates of this type are known; see, for example, DE 10 2004 032 256 B3. Such aggregates are used as compact units in various types of conveyor and hoisting gear for actuation of lifting cylinders. The pertinent hydraulic pump is conventionally driven by an electric motor, especially for nonstationary applications, for example, in the actuation of loading platforms. Direct current motors are used which can be operated in a power class of about 0.8 kW to 3.0 kW from the pertinent on-board network.

As a result of the diverse fields of application and the resulting different installation situations, such hydraulic aggregates are conventionally implemented in various design concepts. Fundamental differences exist, especially between versions for installation with a vertical major axis and versions for horizontal installation.

SUMMARY OF THE INVENTION

An object of the invention is to provide a hydraulic aggregate with a construction permitting use in different installation situations without a change of the design concept being necessary.

This object is basically achieved according to the invention by a hydraulic aggregate where the entry end of the intake line via which the hydraulic pump takes hydraulic fluid from the tank is situated at that location within the tank at which the bottom of the fluid in the tank is located, regardless of whether the aggregate is installed with the major axis vertical or whether the installation position is horizontal. In this way, a reversible unit in the manner of a modular system is devised with which different situations of use and installation can be covered.

Preferably, the tank has an end wall part on the end side relative to the major axis and at least one other boundary wall part which directly follows it. The arrangement can be made such that the entry end of the intake line is in the transition region from the end wall part and boundary wall part. This arrangement ensures that both for a vertical installation position in which the end wall part forms the tank bottom, and for a horizontal installation position in which the boundary wall part which follows the end wall part forms the tank bottom, the entry end of the intake line is located on the bottom where the fluid is present.

Especially advantageously at least a large part of the tank has a shape inscribed in a rectangular solid or cuboid, preferably with a more or less square outline of the end-side end wall part. The entry end of the intake line is located closely adjacent to one corner of the end wall part, that is, in the region of the rectangular solid or cuboid in which two wall parts border one another at a right angle. Depending on whether the installation position is vertical or horizontal, one of the wall parts forms the tank bottom.

Especially advantageously, the arrangement is made such that the fill inlet of the tank is on the cover wall of the rectangular solid or cuboid. The cover wall is opposite the end-side end wall part, in the region of that corner diagonally opposite the corner assigned to the entry end of the intake line. Not only is a reversing possible between the vertical and horizontal installation positions, but for the horizontal installation position the two side walls of the rectangular solid or cuboid bordering the corner assigned to the entry end of the intake line form the tank bottom. In other words, for the horizontal installation position, another reversing possibility exists, specifically one possible rotation also around the major axis of the device which is horizontal in this case.

Especially preferred, for mounting the connecting body on the tank, its cover wall has a round socket projecting from its surface with a flange edge for contact of the connecting flange of the connecting body. A tension clip with a hollow section extends positively over the tank-side flange edge and the connecting flange of the connecting body. In this way, especially simple and reliable linking of the metallic connecting body to a tank made of a UV-resistant material, for example, of PE material, is possible without screw fittings being necessary with the disadvantages as ordinarily occur in screw connections between metal bodies and thin-walled plastic bodies.

Advantageously, a hood, preferably likewise of UV-resistant plastic, in the form of a rectangular solid or cuboid, is open on one side in which the mounted part located on the tank can be housed. The hood open side can be mounted on the tank. The linking can likewise take place positively when a groove-like indentation is formed in the boundary wall parts of the tank forming the side walls of the rectangular solid or cuboid and extends continuously in a plane perpendicular to the major axis in the vicinity of the cover wall over the periphery of the rectangular solid or cuboid. This indentation in interaction with an end rib projecting to the inside on the end edge surrounding the open side of the rectangular solid or cuboid can form the positive connection by engagement of the end rib of the hood with the indentation of the tank.

To form an essentially smooth box shape of the aggregate, the side walls of the hood mounted on the tank can form planar extensions of the side walls of the rectangular solid or cuboid of the tank. A protected (for example, against rock impact and against UV radiation) unit is then devised which is closed, except for the accesses to electrical and hydraulic connections.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
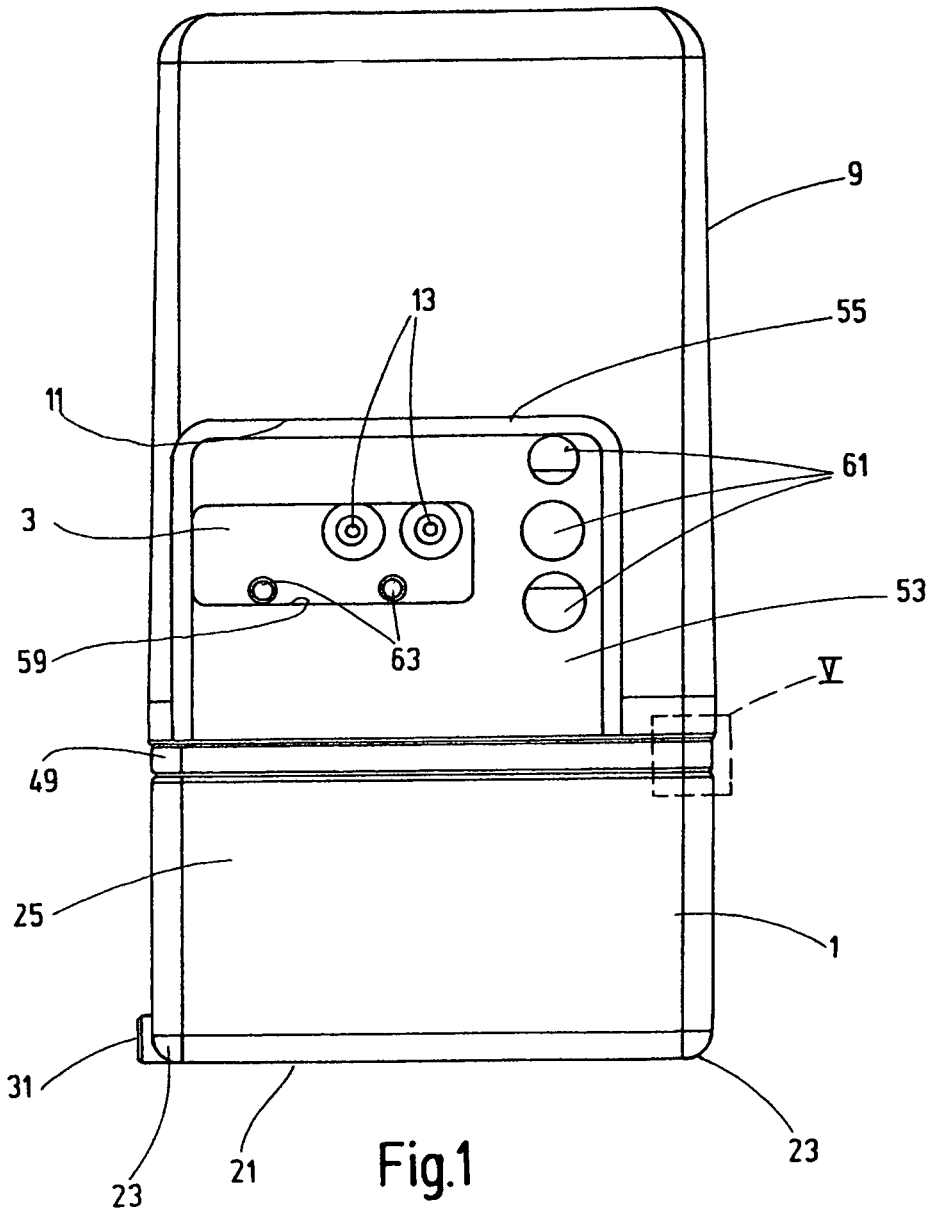
FIG. 1 is a slightly schematically simplified front elevational view of a hydraulic aggregate according to an exemplary embodiment of the invention, shown in the vertical installation position.
Figure 2:
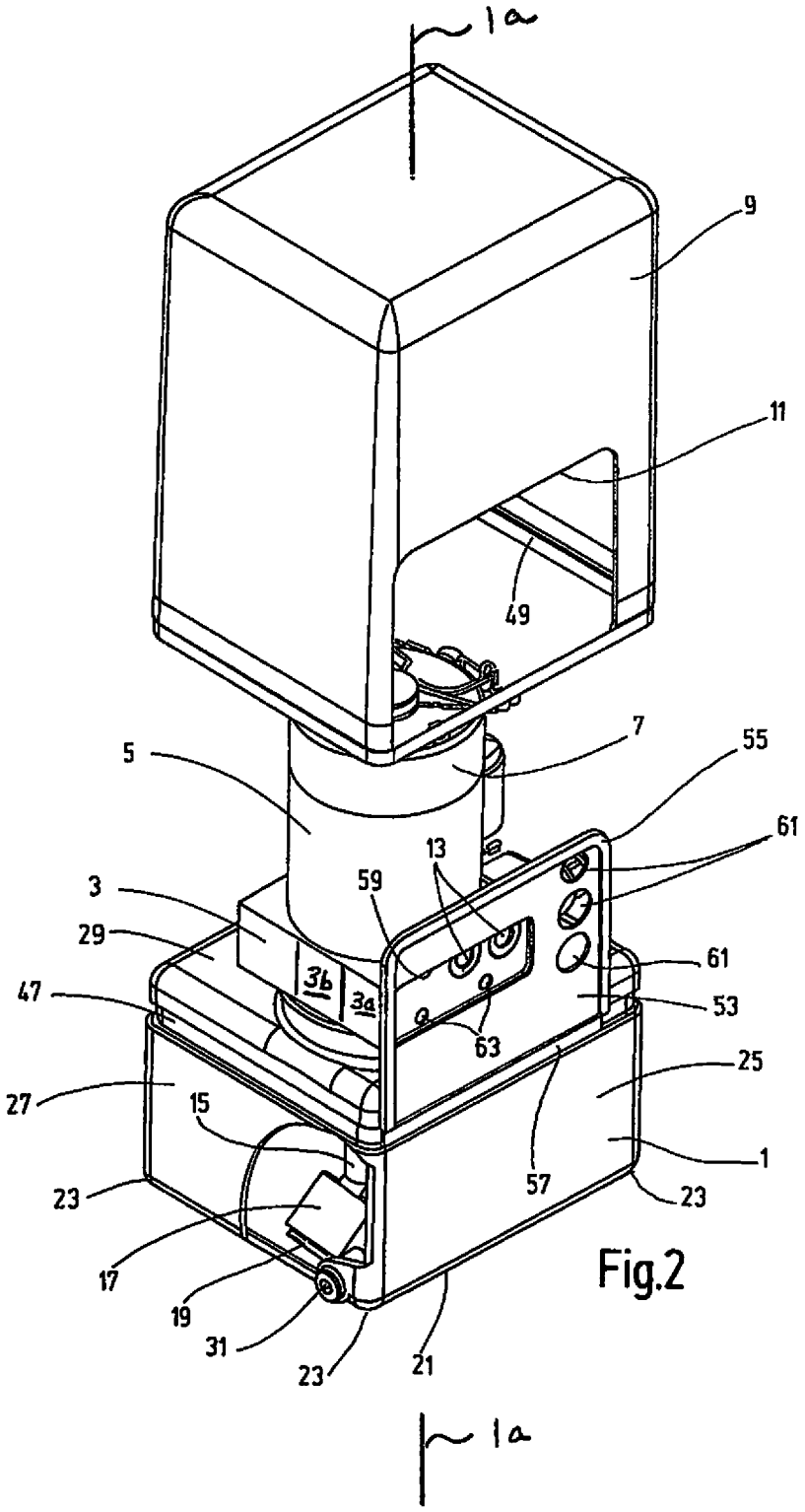
FIG. 2 is a schematically simplified perspective view of the hydraulic aggregate of FIG. 1 in the vertical installation position, with the hood partially open and the tank shown partially cut away.
Figure 3:
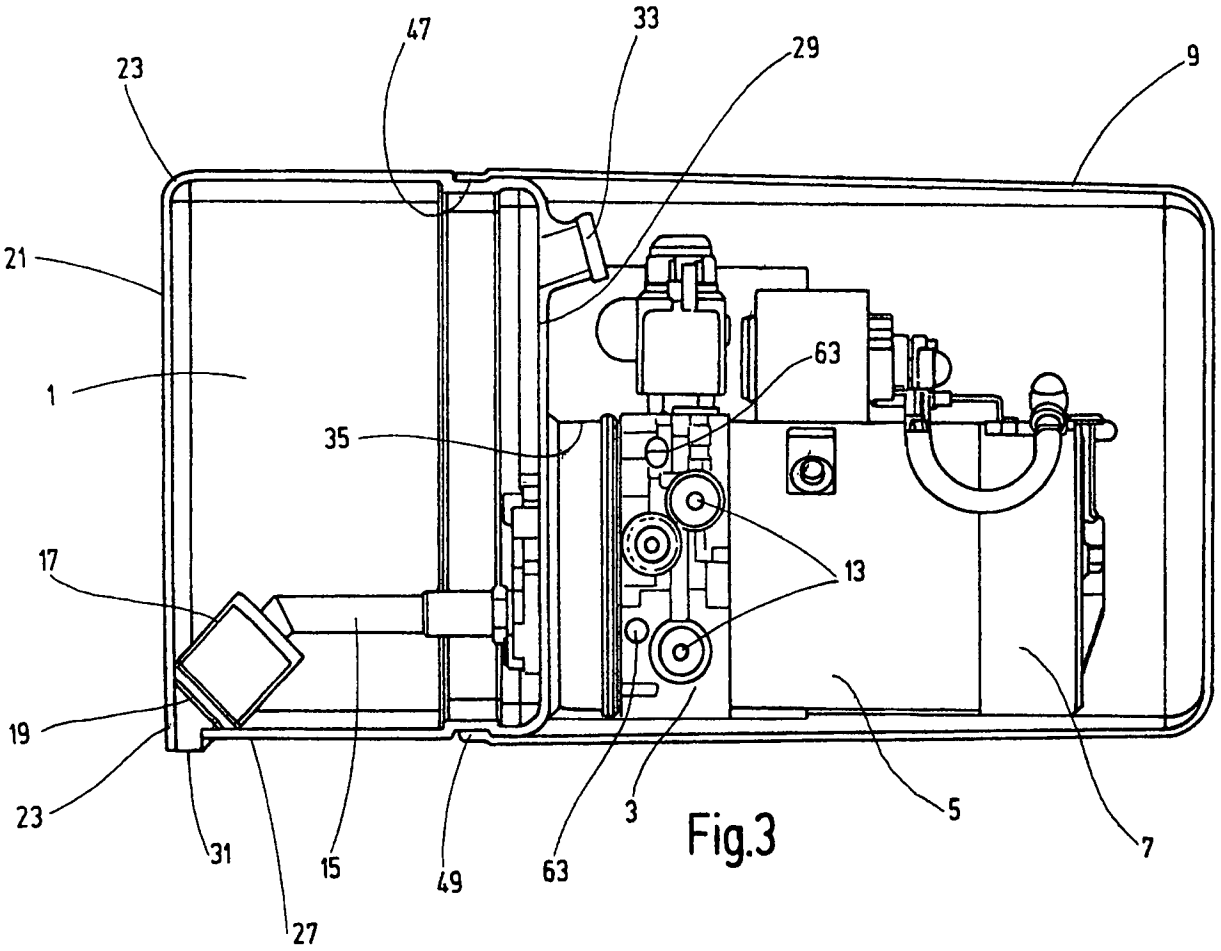
FIG. 3 is a schematically simplified side elevational view of the hydraulic aggregate of FIG. 1 in the horizontal installation position, with one side wall each of the hood and tank being omitted for viewing into the interior.

FIGS. 1 to 3 illustrate overall representations of the exemplary embodiment of the aggregate according to the invention. FIG. 1 showing the exemplary embodiment in the closed state, an essentially closed box shape being formed. FIGS. 2 and 3 illustrates the aggregate partially open, from which inner components can be removed. Proceeding from an end-side tank 1, components being functional elements are mounted directly on the tank, specifically a connecting body 3 and a hydraulic pump 5. The pump 5 is an electrically driven motor-pump unit with a DC motor 7. A hood 9 shown lifted in FIG. 2 and having largely the form of a rectangular solid or cuboid open on one side, when it is mounted on the tank as shown in FIGS. 1 and 3, forms a jacket for the components mounted on the tank 1. The jacket has on only one side a wall opening 11 forming a passage for hydraulic and electrical lines to the connecting body 3 and for fasteners acting on the connecting body 3. The connecting body 3 is a metallic valve block with a valve arrangement or device 3*a* for controlling hydraulic ports 13 and has a line arrangement 3*b* for removal and return of hydraulic fluid into and out of the tank 1. In the figures, only one intake line 15 of the line arrangement is visible. On the end of the intake line 15 is a suction filter 17 whose filter inlet forms the entry end 19 of the intake line 15.

According to the shape of the hood 9, the tank 1 largely also has the form of a rectangular solid or cuboid with an end-side planar end wall 21. Aside from the rounding on its corners 23, end wall 21 has a rectangular outline which is more or less square. As further boundary wall parts of the tank 1, planar side walls 25 and 27 (FIG. 2) follow and extend to the upper cover wall 29 of the tank 1. As can be taken from FIGS. 2 and 3, the entry end 19 of the intake line 15 is closely adjacent to a corner 23, i.e., in a junction region in which the end wall 21 and the side walls 25 and 27 abut one another. Moreover, in this corner region, there is a fluid drain 31 in the side wall 27. There is a fill inlet 33 visible only in FIG. 3 on the cover wall 29 of the tank 1 at a location diagonally opposite the entry end 19 of the intake line 15, relative to the rectangular solid or cuboidal shape of the tank 1; i.e., in FIG. 3 it is offset into the plane of the drawing to the back relative to the entry end 19 which lies in the plane of the drawing.

In this positioning of the entry end 19 of the intake line 15 and the fill inlet 33, it is ensured that the entry end 19 is located underneath the fluid level present in the tank (1), and the fill inlet 33 is above the fluid level, even if the tank 1 and the hydraulic aggregate as a whole assume different installation positions. FIGS. 1 and 2 show the aggregate in a position corresponding to a vertical installation position in which the end wall 21 forms the tank bottom on which the bottom of the fluid is present. In the horizontal installation position shown in FIG. 3 and in which one side wall 27 forms the tank bottom, the entry end 19 of the intake line 15 is likewise located underneath the fluid level, with the fill inlet 33 being located above the fluid level, as in the vertical installation position. In contrast to FIG. 3, for a horizontal installation position the orientation could also be such that the side wall 25 which is visible in FIG. 2 and which is omitted in FIG. 3 forms the tank bottom. Compared to the situation shown in FIG. 3, another reversing possibility of rotation around the major axis 1*a* of the device exists for a horizontal installation position.

Figure 4:
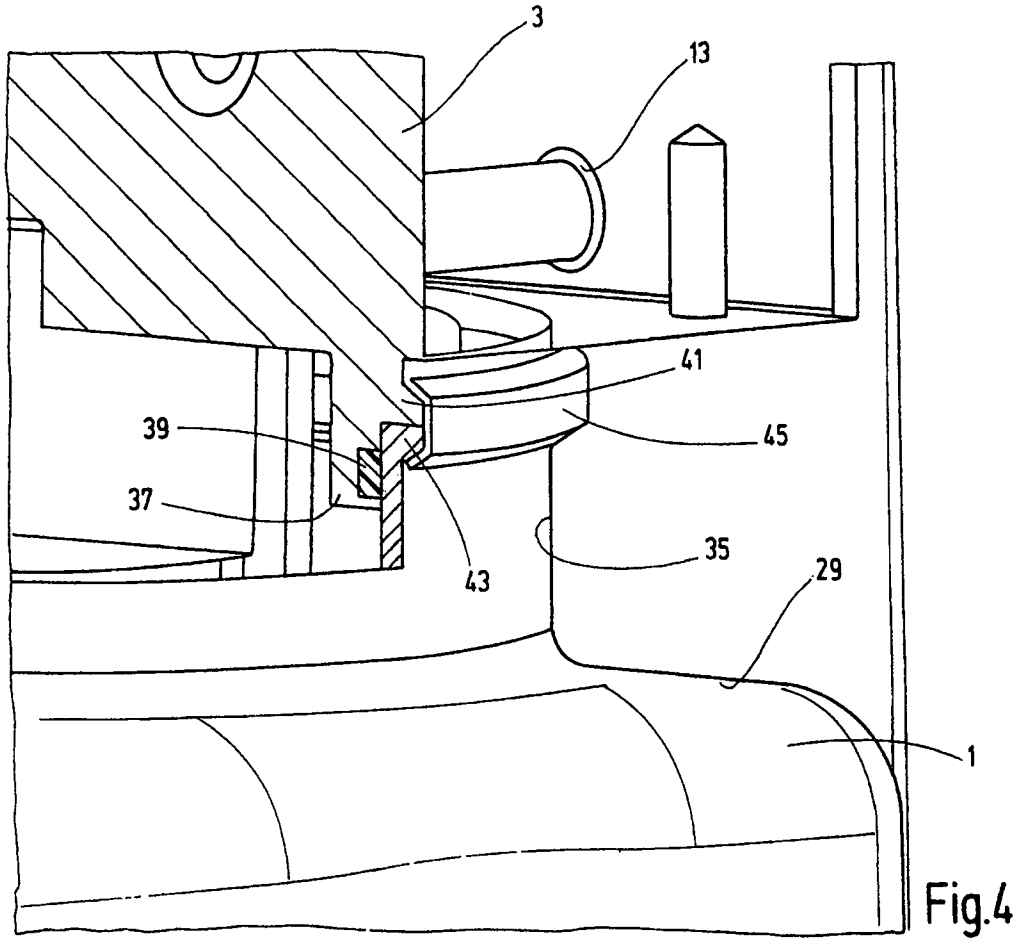
FIG. 4 is a schematically simplified, enlarged partial perspective view of only the linking region between the tank and the connecting body, partially cut open.

Details of the mounting of the connecting body 3, which is a metallic valve block, are shown in FIG. 4. As shown, on the upper cover wall 29 of the tank 1, a round pipe socket 35 is molded on. Pipe socket 35 has a comparatively large diameter, in the illustrated example, is more than half the width of the tank 1 and is located offset out of the central region of the cover wall 29, as can be seen from FIG. 3. The intake line 15 and a return line (not shown) extend through the socket 35 to the connecting body 3. Connecting body 3 has a ring body 37 engaging the socket 35 with a seal 39 and forms a radially projecting connecting flange 41 adjoining a flange edge 43 of the socket 35. A tension clip 45 has a hollow profile matched to the connecting flange 41. The tension clip 45 extends positively over the connecting flange 41 and flange edge 43. A toggle clamp (not shown) is provided on the tension clip 45.

As already mentioned, the hood 9 has the form of a rectangular solid or cuboid, is matched to the outside shape of the tank 1, is open on one side and, aside from an opening 11, is closed so that in the assembled state the hydraulic aggregate, as shown in FIG. 1, has an essentially closed box shape. To mount the hood 9 on the tank 1, in the vicinity of its cover wall 29, is provided with an indentation 47 in the shape of a groove with rounded side walls and extending continuously over the entire peripheral region of the tank 1. This indentation 47 forms a seat for positive accommodation of an end rib 49 projecting to the inside and made on the end edge surrounding the open side of the rectangular solid or cuboid of the hood. This end rib 49 can be snapped into the indentation 47 with slight elastic deformation of the end edge of the hood. For additional security, a metallic tension band 51, see FIG. 5, can be provided to lock the end rib in the indentation 47.

Figure 5:
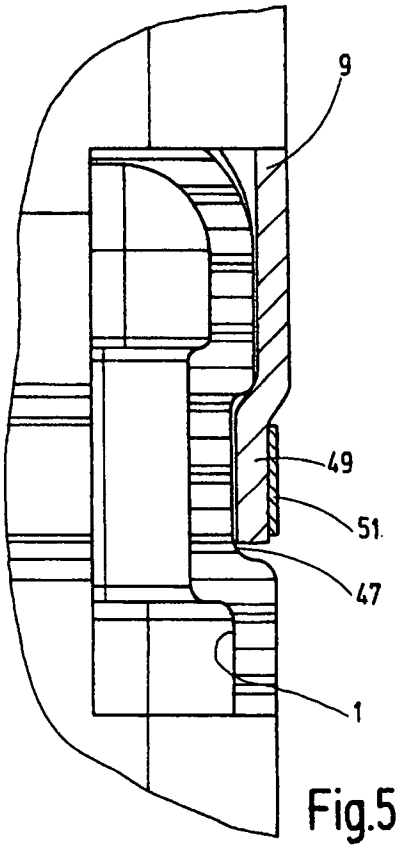
FIG. 5 is a front elevational view of a partial extract of only the region designated as V in FIG. 1, shown greatly enlarged relative to FIG. 1.

The termination part located on the opening 11 with the hood 9 closed is a sheet metal plate 53 in the form of a rounded rectangle whose edge is encompassed on three sides by a U-profile seal 55 extending on one side wall 25 along the facing end of the connecting body 3 along the major axis. When the hood 9 is in place, the profile seal 55 forms the seal relative to the edge of the opening 11 of the hood 9. The side of the sheet metal plate 53 bordering the tank 1 on the fourth side assigned to the tank 1 forms an end edge 57 deformed out of the plane of the plate. The end edge 57 can be positively held in the indentation 47 where it can be secured by cementing or welding. With the hood 9 in place, the end rib 49 of the hood 9 additionally extends over the end edge 57 of the plate 53, optionally with additional locking by an overreaching tension band 51, as shown in FIG. 5.

As viewed in FIG. 2, in an embodiment which is not further detailed, the wall of the hood 9, which wall is the rear wall here, can be arranged as a guide part in an extension of the side wall 25 of the tank 1. For example, the rear wall of the hood can be secured on the projecting plate 53. In this respect, the remaining three side parts of the hood 9 are then slipped from the top onto the tank 1 and are connected, as described, via longitudinal guides located on the end on the end sides of the rear wall. In doing so, as viewed in FIG. 2, the back end wall of the hood 9 can also be an integral component of the projecting plate arrangement 53, which in turn can be secured on the tank 1 and/or on the connecting body 3.

As can be seen from FIGS. 1 and 2, the sheet metal plate 53 has a passage 59 and openings 61. The passage 59 forms an access to the hydraulic ports 13 on the connecting body 3 and to threaded bores 63 in the connecting body 3 designed for fastening screws to secure the aggregate on the pertinent bracket.

As a modular system, the invention allows not only the coverage of different installation situations due to the available reversing possibility, but can also be easily adapted to different power classes. Thus, for example, the volume of the tank 1 can be easily matched to the requirements of the hydraulic system by the tank height being increased, with only the intake line 15 needing to be provided with a correspondingly greater length. All other components and their linking to the tank 1, in which optionally only the distance between the end wall 21 and the top wall 29 has changed, remain unchanged.

While one embodiment has been chosen to illustrate the invention, it will be understood by those skilled in the art that various changes and modifications can be made therein without departing from the scope of the invention as defined in the appended claims.

What is claimed is:

1. A hydraulic aggregate for supplying pressurized fluid, comprising:

a tank having an axial end wall, a first side wall, a cover wall and a major axis, said end wall and said first side wall being directly connected to each other at a transition region;

a hydraulic pump on said cover wall;

a connecting body on said cover wall of said tank and having a valve device and a line arrangement for intake and return of hydraulic fluid to and from said tank, said line arrangement including an intake line having an entry end located within said tank and at said transition region, said entry end of said intake line being located closely adjacent a first corner of said end wall of said tank; and a fluid drain closely adjacent said first corner of said end wall and in said first side wall;

whereby said aggregate is operable in a first orientation with the major axis of the tank being vertical and the end wall forming a bottom of the tank, a second orientation with the major axis horizontal and the first side wall forming the bottom of the tank, or a third orientation with the major axis horizontal and the first side wall not forming the bottom of the tank, such that said entry end is adjacent the bottom of the tank when the aggregate is in each of the first, second or third orientations.

2. A hydraulic aggregate according to claim 1 wherein at least a large part of said tank is inscribed in a rectangular solid.

3. A hydraulic aggregate according to claim 1 wherein said end wall comprises a substantially square outline.

4. A hydraulic aggregate according to claim 1 wherein a fill inlet is on said cover wall, said cover wall being opposite said end wall, said fill inlet being at a second corner of said rectangular solid diagonally opposite said first corner.

5. A hydraulic aggregate according to claim 4 wherein said cover wall comprises a round socket mounting said connecting body thereon, said round socket having a flange edge projecting radially from a surface of said round socket and contacting a connecting flange on said connecting body; and a tension clip with a hollow section extends over said flange edge and said connecting flange.

6. A hydraulic aggregate according to claim 4 wherein a rectangular solid hood is has an open side, is coupled to said tank and houses said pump and said connecting body, said open side being mounted on said tank.

7. A hydraulic aggregate according to claim 6 wherein a groove shaped indentation is formed in said first side wall and in other side walls of said tank, said indentation extending continuously in a plane perpendicular to the major axis in a vicinity of said cover wall on a periphery of said side walls.

8. A hydraulic aggregate according to claim 7 wherein said hood comprises an end edge with an end rib surrounding said open side of said hood, said end rib projecting radially inwardly and engaging said indentation in said tank mounting said hood on said tank.

9. A hydraulic aggregate according to claim 6 wherein said hood comprises side walls mounted on said tank and forming planar extension of said first side wall and other side walls of said tank.

10. A hydraulic aggregate according to claim 1 wherein said tank comprises a second side wall perpendicular to said first side wall and said end wall, said entry end of said intake line being closely adjacent a corner formed by said first and second side walls and said end wall.

11. A hydraulic aggregate according to claim 1 wherein said tank comprises second, third and fourth side walls, said side walls extending between and perpendicular to said end wall and said cover wall.

12. A hydraulic aggregate according to claim 11 wherein said first and second side walls and said end wall extend in three perpendicular planes to define said first corner, said entry end of said intake line being closely adjacent said first corner.

13. A hydraulic aggregate for supplying pressurized fluid, comprising:

a tank having an axial end wall, a first side wall, a second side wall, a third side wall, a fourth side wall, a cover wall and a major axis, said end wall and said first side wall being directly connected to each other at a transition region, said first, second, third and fourth side walls extending between and perpendicular to said end wall and said cover wall, said end wall and said first and second side walls extending in three perpendicular planes to define a first corner and being planar;

a hydraulic pump on said wall cover;

a connecting body on said cover wall of said tank and having a valve device and a line arrangement for intake and return of hydraulic fluid to and from said tank, said line arrangement including an intake line having an entry end located within said tank, at said transition region and closely adjacent said first corner; and a fluid drain closely adjacent said first corner;

whereby said aggregate is operable in a first orientation with the major axis of the tank being vertical and the end wall forming a bottom of the tank, a second orientation with the major axis horizontal and the first side wall forming the bottom of the tank, or a third orientation with the major axis horizontal and the first side wall not forming the bottom of the tank, such that said entry end is adjacent the bottom of the tank when the aggregate is in each of the first, second or third orientations.

14. A hydraulic aggregate according to claim 13 wherein at least a large part of said tank is inscribed in a rectangular solid.

15. A hydraulic aggregate according to claim 14 wherein a fill inlet is on said cover wall, said cover wall being opposite said end wall, said fill inlet being at a second corner of said rectangular solid diagonally opposite said first corner.

16. A hydraulic aggregate according to claim 15 wherein said cover wall comprises a round socket mounting said connecting body thereon, said round socket having a flange edge projecting radially from a surface of said round socket and contacting a connecting flange on said connecting body; and a tension clip with a hollow section extends over said flange edge and said connecting flange.

17. A hydraulic aggregate according to claim 15 wherein a rectangular solid hood has an open side, is coupled to said tank and houses said pump and said connecting body, said open side being mounted on said tank.

18. A hydraulic aggregate according to claim 17 wherein a groove-shaped indentation is formed in said side walls of said tank, said indentation extending continuously in a plane perpendicular to the major axis in a vicinity of said cover wall on a periphery of said side walls.

19. A hydraulic aggregate according to claim 18 wherein said hood comprises an end edge with an end rib surrounding said open side of said hood, said end rib projecting radially inwardly and engaging said indentation in said tank mounting said hood on said tank.

20. A hydraulic aggregate according to claim 17 wherein said hood comprises side walls mounted on said tank and forming planar extension of said side walls of said tank.

* * * * *